US005213474A

United States Patent [19]

Daniel

[11] Patent Number: 5,213,474

[45] Date of Patent: May 25, 1993

[54] PUMP UNIT

[75] Inventor: William H. Daniel, Rogers, Ark.

[73] Assignee: LCD, Inc., Rogers, Ark.

[21] Appl. No.: 866,095

[22] Filed: Apr. 6, 1992

[51] Int. Cl.[5] ..... F04D 29/18

[52] U.S. Cl. ..... 415/206; 415/218.1; 415/219.1; 416/179; 416/188

[58] Field of Search ..... 415/203, 206, 207, 218.1, 415/219.1, 90; 416/179, 182, 185, 188; 417/423.14

[56] References Cited

U.S. PATENT DOCUMENTS

| | | | |
|---|---|---|---|
| 3,261,297 | 7/1966 | Daniel . | |
| 3,280,748 | 10/1966 | Ogles | 415/218.1 |
| 3,575,525 | 4/1971 | Fox et al. | 415/218.1 |
| 3,734,640 | 5/1973 | Daniel | 416/185 |
| 3,864,055 | 2/1975 | Kletschka et al. | 415/90 |
| 3,961,758 | 6/1976 | Morgan | 415/218.1 |
| 5,102,066 | 4/1992 | Daniel . | |
| 5,137,424 | 8/1992 | Daniel | 415/206 |

FOREIGN PATENT DOCUMENTS 605902 11/1934 Fed. Rep. of Germany ..... 415/76

*Primary Examiner*—Edward K. Look
*Assistant Examiner*—James A. Larson
*Attorney, Agent, or Firm*—Young & Thompson

[57] ABSTRACT

A vacuum pump, denoted "VUMP", comprises a pair of nested conical or bell-shaped housings, wherein at least the outer bell-shaped housing forms a part of the pump chamber and has a central inlet. The impeller structure of the pump comprises a circular series of airfoil elements so disposed as to at least partially occupy the annular space defined by the nested conical or bell-shaped members. The airfoil elements each have a vacuum surface directed axially of the impeller towards the central pump inlet. Fluid conveyed through the pump is introduced to the central inlet and directed peripherally of the pump chamber by the inner conical member. Rotation of the circular series of airfoil elements produces a strong vacuum force within the pump that serves to impel fluid through the pump by volumetric displacement.

4 Claims, 5 Drawing Sheets

PUMP UNIT

The present invention relates to pumps, more particularly of the centrifugal type, in which a series of spaced vanes moves in a circular path and fluid is drawn into an annular region occupied by the circular series of vanes, and is impelled axially of the vanes through the annular space toward a discharge orifice of the pump.

The present invention is an improvement on and a departure from the pump disclosed in U.S. Pat. No. 3,261,297 to the same inventor, the entirety of which patent is hereby expressly incorporated by reference.

Curiously, the structure of the impeller provided in the pump according to the present invention most nearly resembles the propeller of the inventor's copending application Ser. No. 07/560,582 filed Jul. 30, 1990, U.S. Pat. No. 5,102,066 which application is directed to a vertical take-off and landing aircraft. The inventor has discovered, however, that certain of the structure which serves to move a body through a fluid may also to advantage be incorporated in a pump that serves to move a fluid through a body. Accordingly, the disclosure of U.S. patent application Ser. No. 07/560,582 is also hereby expressly incorporated by reference.

In conventional centrifugal pumps, the vanes of the impeller are paddle-shaped, and generally impel fluid radially outwardly of the impeller into the volute of the pump, by a mechanical pushing action exerted by the vanes on the liquid. The inventor's extensive design studies of centrifugal pumps over the past thirty years have revealed to him that this mechanical pushing action exerted by conventional paddle-shaped vanes gives rise to the undesired phenomena of recirculation, backpressure, cavitation and friction that have always plagued conventional pressure pumps.

In the inventor's U.S. Pat. No. 3,261,297, a first attempt was made to solve these problems by providing a centrifugal pump that operated under vacuum, rather than under pressure. In particular, the pump of the inventor's earlier patent include an impeller structure comprising a circular series of airfoil vanes arranged with the leading edge of one vane following the trailing edge of the vane in front of it, such that the vanes all pointed in the same direction around the circle. In that patent, however, the lift surfaces of the vanes were directed radially of the impeller, and in particular the vacuum surfaces were directed radially inwardly and the pressure surfaces were directed radially outwardly.

The inventor's copending application Ser. No. 07/521,565 provided a second and considerably more successful attempt to solve the problems attending conventional centrifugal pumps that operate under pressure. In that application, the constant axial extent pump chamber of the inventor's earlier patent was replaced by a pump chamber whose axial extent is continuously increasing from the pump inlet and radially outwardly to the circular series of vanes.

The inventor's copending application Ser. No. 07/560,582 represents a further departure from his earlier contributions, by providing a circular series of airfoil vanes that rotates within an annular space defined by a pair of nested bell-shaped housings. In the propeller of that aircraft, it is to be noted that the airfoil elements have their vacuum and pressure surfaces facing axially of the axis of rotation of the propeller, in contrast to the inventor's earlier pumps in which the vacuum and pressure surfaces of the airfoil vanes were directed radially of the axis of impeller rotation.

It has now surprisingly been discovered that the propeller structure shown in copending application Ser. No. 07/560,582 may be modified and used to advantage in a novel pump structure in which the circular series of airfoil vanes rotates in the annular space defined between the bases of two coaxial nested cones, the outer cone being truncated to provide a central inlet for the pump, and the two cones together defining a chamber in which fluid admitted centrally of the chamber is drawn by the rotating impeller through the chamber and into the rotating series of vanes.

It is accordingly a principal object of the present invention to provide a pump operating under vacuum, in which fluid is impelled not by the mechanical pushing action of paddle-shaped vanes, but rather by volumetric displacement of further incoming fluid drawn into the pump under vacuum.

It is a further object of the invention to provide a pump employing a circular series of airfoil-shaped vanes, in which fluid entering the pump axially and centrally through a central opening is expelled axially and peripherally through the rotating series of vanes, into a discharge chamber.

It is a yet further object of the invention to provide a pump unit in which a pair of nested coaxial cones cooperate to define a pump chamber that directs fluid inlet centrally of the chamber to an annular space occupied by the rotating circular series of airfoil vanes.

The above and other objects and advantages of the invention will be more readily apparent from a reading of the following description of various preferred embodiments thereof, taken in conjunction with the accompanying drawings, in which.

Figure 1:
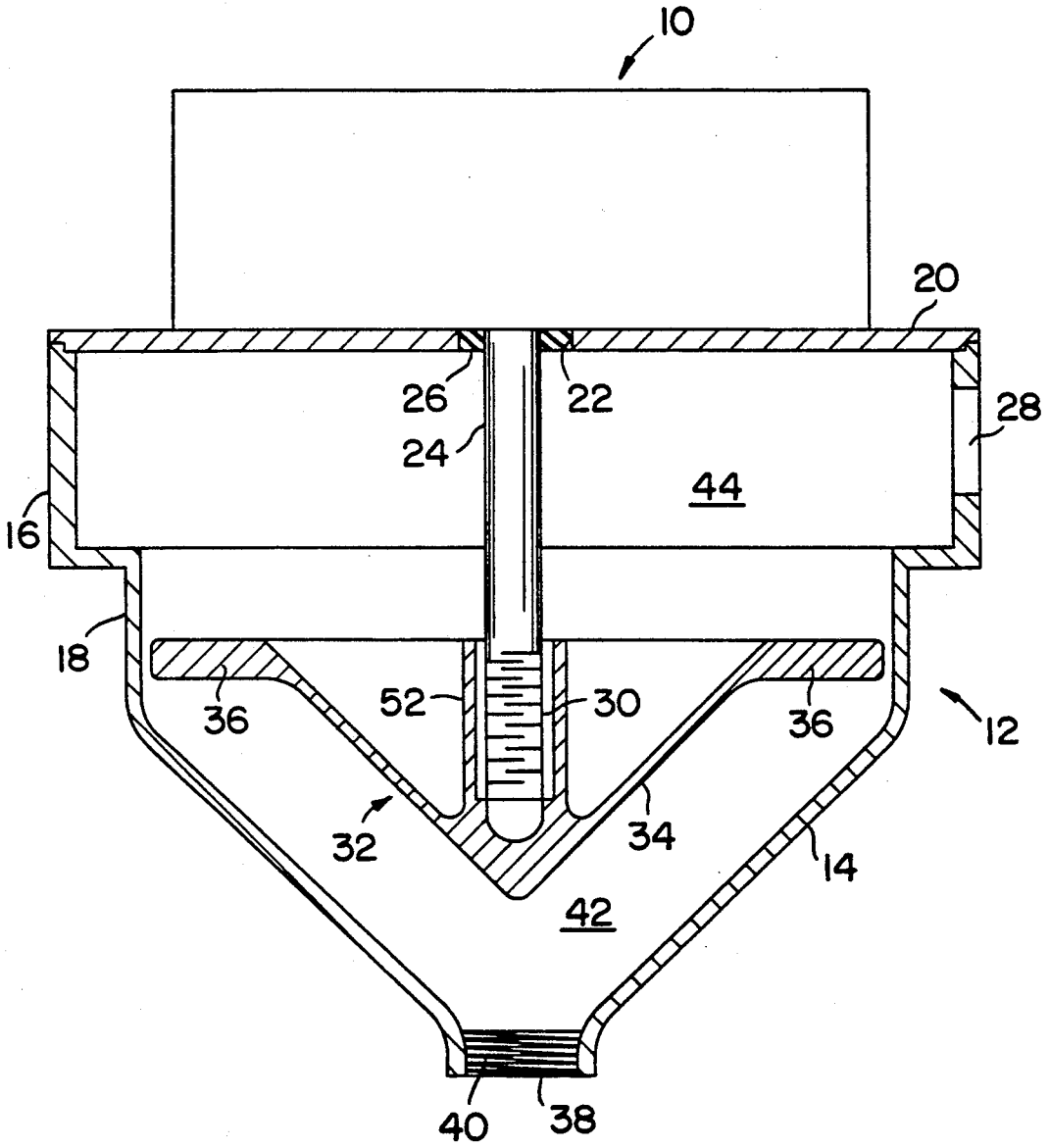
FIG. 1 is an axial cross section through a pump constructed in accordance with a first embodiment of the invention.

Referring now to FIG. 1 of the accompanying drawings, shown therein is a pump in which a motor indicated schematically at 10 is mounted on the top side of a pump casing shown generally at 12.

The chamber 12 comprises a lower conical portion 14 joined to an upper box-shaped portion 16 via a central cylindrical portion 18. The upper box-shaped portion 16 may conveniently be closed by a cover member 20. The cover member 20 comprises a central opening 22 through which passes the output shaft 24 of motor 10. A seal 26 is provided within opening 22 surrounding the shaft 24, to provide bearing for the shaft 24 and also to prevent fluid pumped through the pump unit from leaking out through the opening 22.

Also provided in the upper box-shaped portion 16 is a peripheral exhaust port 28, which is adapted to receive an outlet conduit by means of screw threading or the like.

The distal end of output shaft 24 comprises screw threading 30 or other equivalent fixation means, by which the output shaft 24 is rigidly coupled to an impeller generally indicated at 32. The impeller 32 comprises a central conical portion 34, at the base of which are secured or integrally formed a circular series of airfoil vanes 36. The impeller 32 according to this embodiment will be described in further detail below with reference to FIG. 2.

It will be noted that the impeller 32 is received within the pump chamber 12 such that the conical portion 34 of impeller 32 and the lower conical portion 14 of chamber 12 together describe a pair of nested coaxial cones. Because the cones described by the conical portions 34 and 14 are congruent in this embodiment, the spacing is constant between the outer surface of conical portion 34 and the inner surface of conical portion 14.

It will be noted however, that the conical portions 34 and 14 need not be congruent; instead, the outer conical portion 14 could have a greater conical angle than the inner conical portion 34, in which case the spacing therebetween would gradually increase from the central inlet 38 to the vanes 36. Accordingly, it is preferred that the conical angle described by the outer conical portion 14 at least equal the conical angle described by the inner conical portion 34. It will also be appreciated that the term "conical" as used to describe the nested portions 34 and 1 should be understood to include bell-shaped geometries as described in the inventor's copending application Ser. No. 07/560,582 mentioned above.

The lower conical portion 14 of pump chamber 12 is truncated to form a central inlet 38. As shown in FIG. 1, inlet 38 comprises internal screw threading 40 enabling connection of an inlet pipe to the conduit. It will be noted, however, that screw threading is only one example of a suitable connection mechanism; other conventional pipe coupling mechanisms such as locking slots cooperating with projections of the pipes may equally be used.

The position of impeller 32 within chamber 12 thus defines between impeller 32 and lower conical portion 14 an inlet chamber 42 having the space of a hollow cone, and between impeller 32 and upper box-shaped portion 16 an outlet chamber 44.

Figure 2:
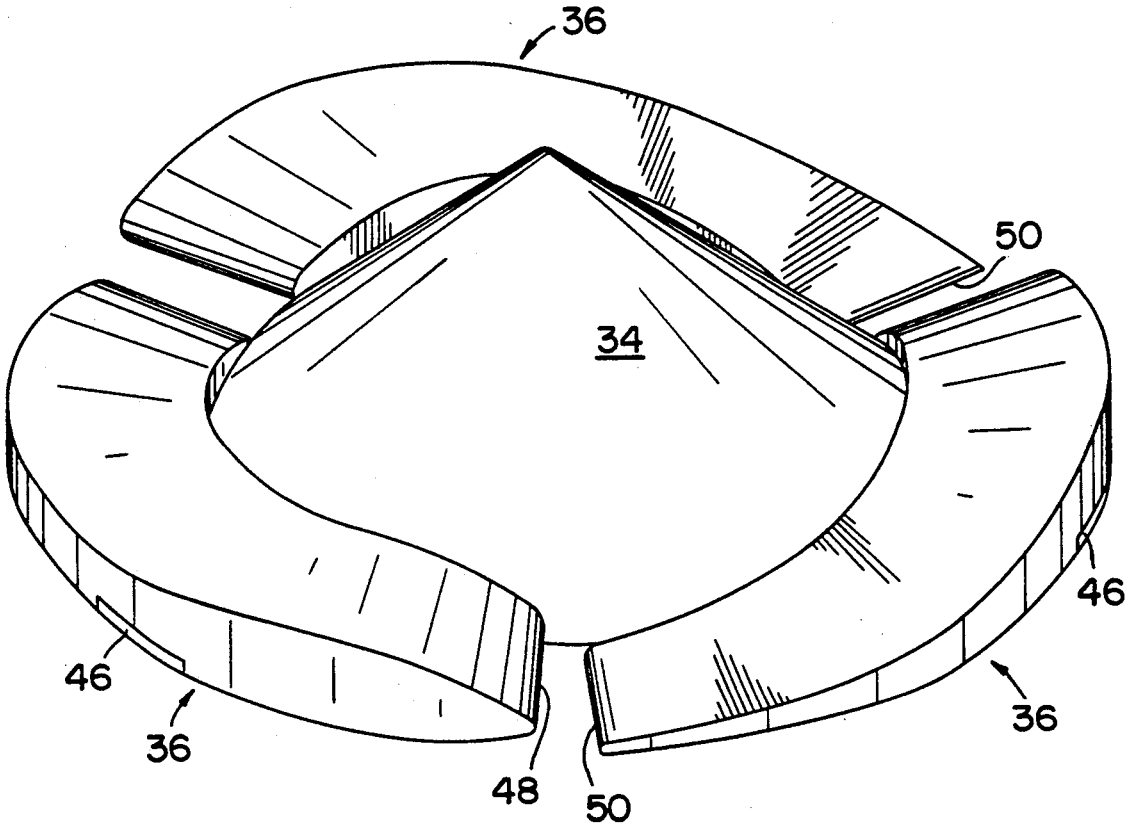
FIG. 2 is a perspective view of the impeller unit used in the pump of FIG. 1.

FIG. 2 shows the impeller 32 of FIG. 1 in perspective, and in better detail. It will be appreciated that the side of the impeller facing up in FIG. 2 is the side which faces down toward inlet 38 in FIG. 1.

As shown in FIG. 2, the impeller 32 comprises a circular series of airfoil elements 36 each rigidly secured to the central conical portion 34. The airfoil elements 36 may be formed integrally with conical portion 34, or, as shown in FIG. 2, may be rigidly secured together by coupling members 46. The coupling members 46 could advantageously have the form of angled plates bolted to recesses in the lower sides of the airfoil elements 36, and also bolted to the inner side of conical portion 34.

Each of the airfoil elements 36 has a leading edge 48 and a trailing edge 50, the airfoil elements being arranged head-to-tail such that the leading edges all face in the same direction about the circular. With reference to FIG. 2, the upper surfaces of the airfoil elements 36 are longer than the lower surfaces, such that when a fluid is drawn across the rotating series of airfoil vanes 36, fluid travelling along the upper surfaces is conducted at a higher speed and therefore a lower pressure. Conversely, a higher pressure is generated on the lower surfaces of the airfoil vanes, with reference to FIG. 2.

Referring again now to FIG. 1, the operation of the pump unit as described above will now be explained. First, an inlet conduit is secured to the central inlet 38 of the pump chamber 42, and the pump unit is primed. Next, the motor 10 is actuated, which results in its output shaft 24 rotating, and in turn impeller 32 rotating via the screw threaded attachment 30 of shaft 24 to impeller 32, via the threaded cylindrical boss 52 provided on the impeller.

As the circular series of airfoil vanes 36 rotates, the longer surface on the sides of the elements facing the inlet 38 generates a profound vacuum force within the inlet chamber 42, which draws in further fluid through the central opening 38. There is also generated a pressure force on the sides of the vanes directed toward the outlet chamber 44; however, it has been found that this pressure force does not retard the flow of fluid through the pump in operation, as the internal volume of the pump chamber is ever increasing from its inlet 38 to its outlet 28.

A working model of the pump illustrated in FIG. 1 has been constructed, and it has proven to lift a column of water significantly higher than a conventional centrifugal pump equipped with paddle-shaped vanes. Moreover, the operation of the pump shown in FIG. 1 is exceptionally smooth, with no indication of any pulsing or cavitation during operation.

In the tested model, the central inlet 38 had a diameter of 1¼". To determine the pumps resistance to losing its prime, a ¼" diameter air tube was introduced through the 1¼" inlet while the pump was in operation pumping water. Although there was a decrease in output water volume corresponding to the decreased inlet area, there was quite surprisingly no loss of prime whatsoever.

Figure 3:
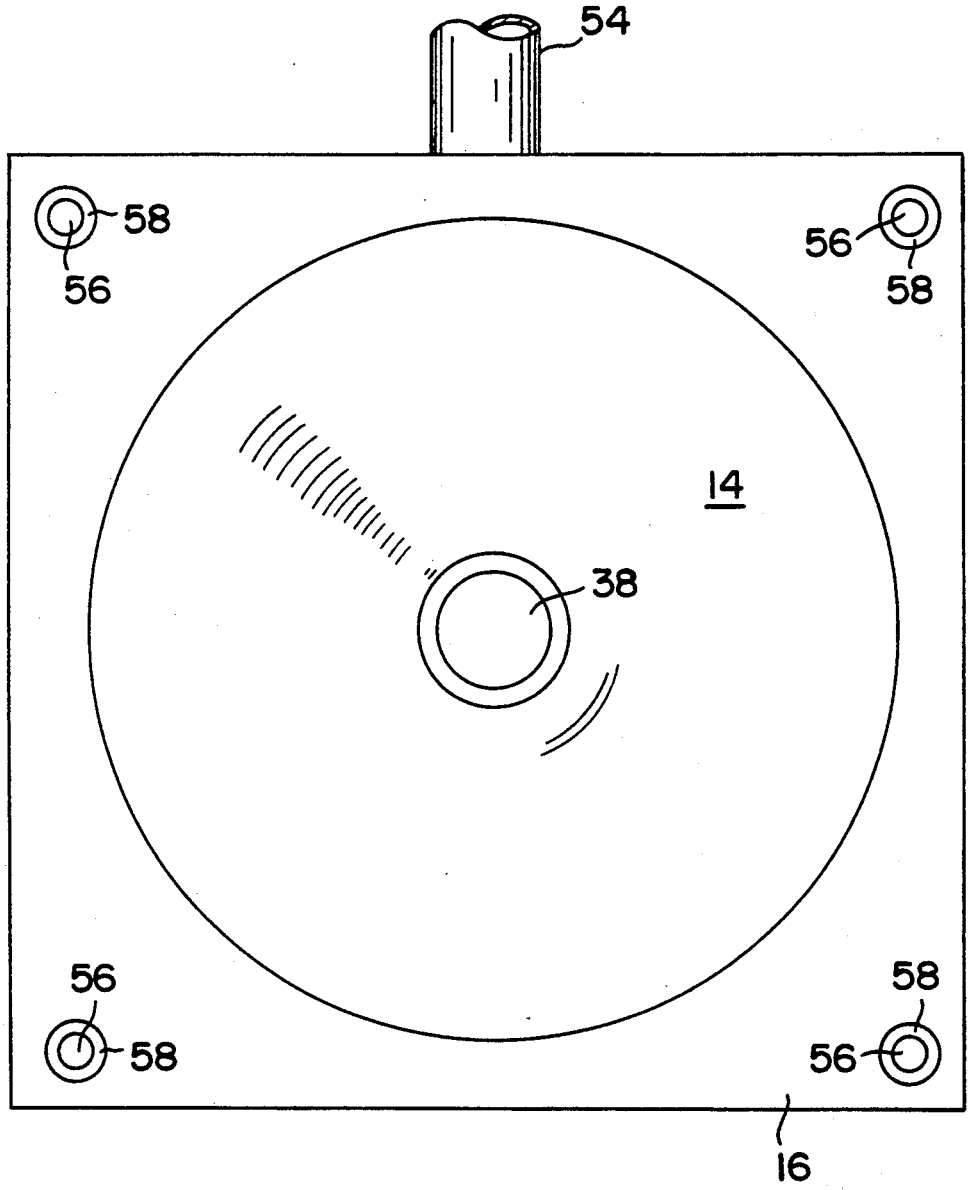
FIG. 3 is a bottom plan view of the pump of FIG. 1.

FIG. 3 is a bottom plan view of the pump of FIG. 1, in which it can be seen that the upper chamber portion 16 is approximately square-shaped in its radial dimension, and further that the lower part of the pump chamber 12 formed by the conical portion 14 and cylindrical portion 18 is centered on the upper portion 16. In this embodiment, a discharge conduit 54 is shown connected to the outlet opening 28 of the upper chamber portion 16.

This view also shows the provision of mounting bores 56 formed centrally of circular recesses 58 in the underside of the box-shaped outlet chamber 16. These bores 56 and recesses 58 permit bolting the pump chamber to a support structure, so that the pump unit may be rigidly secured in its position of use.

Figure 4:
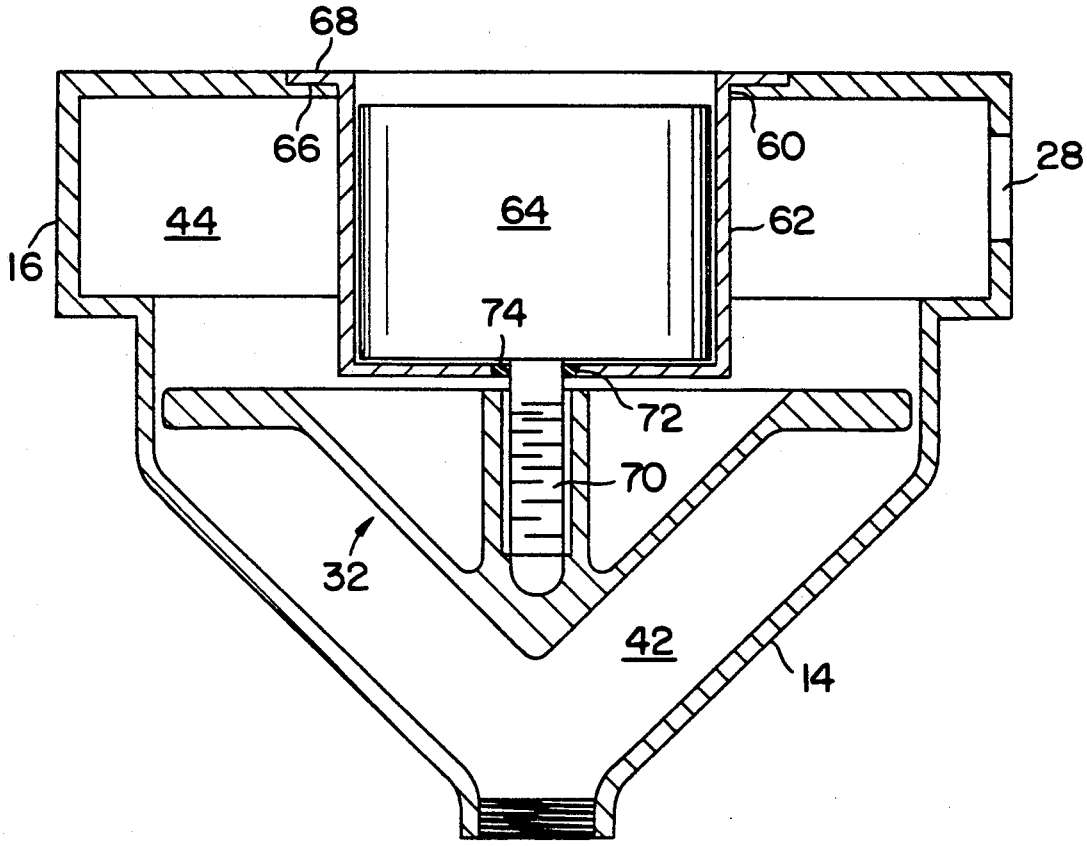
FIG. 4 is an axial cross section taken through a pump constructed in accordance with a second embodiment of the invention.

FIG. 4 is an axial section through a pump unit according to a second embodiment of the invention. Those elements of the FIG. 4 embodiment which are unnumbered or bear the same numerals as the FIG. 1 embodiment are the same as in that embodiment.

In FIG. 4, the upper box-shaped outlet chamber 16 is provided with a substantially larger circular opening 60, which is adapted to receive a drum-shaped container 62 holding motor 64. The opening 60 in upper chamber 16 is preferably surrounded by an annular recess 66, which receives a complementary circular mounting flange 68 extending radially outwardly of drum 62.

Output shaft 70 of motor 64 extends through a lower opening 72 provided in drum 62, and a suitable annular seal 74 is provided therebetween in the same manner as seal 26 of the FIG. 1 embodiment.

The FIG. 4 embodiment permits the overall structure of the pump unit to be more compact, and also permits significantly decreasing the length of output shaft 70 relative to the output shaft 24 of the FIG. 1 embodiment.

In operation, the pump shown in FIG. 4 performs the same as that shown in FIG. 1.

Figure 5:
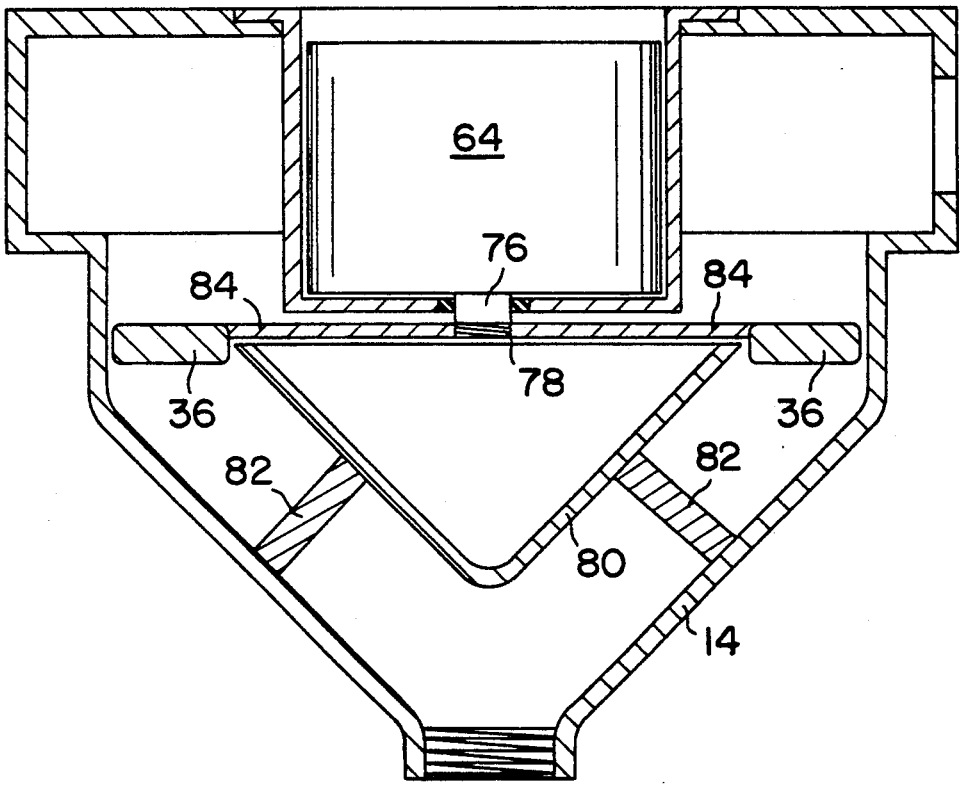
FIG. 5 is an axial cross section taken through a pump constructed in accordance with a third embodiment of the invention.

FIG. 5 is an axial section through a pump unit according to a third embodiment of the invention. Those elements of the FIG. 5 embodiment which are unnumbered or bear the same numerals as the FIG. 4 embodiment are the same as in that embodiment.

In FIG. 5, the impeller structure is modified, in that the inner conical-shaped portion 80 is no longer a part of the impeller, but rather is rigidly secured to the outer conical-shaped portion 14, via struts 82. This embodiment therefore offers the advantage that the weight of the impeller is reduced by subtracting the weight of the inner conical-shaped portion 80.

In the FIG. 5 embodiment, the airfoil elements 36 are rigidly secured to flat radial spokes 84, which are joined at a common central portion screw-threaded to the threading 78 of output shaft 76. In this embodiment, then, the impeller structure formed by airfoil elements 36 and spokes 84 may be exactly as shown in FIG. 2 of my copending application Ser. No. 07/560,582, in which it will be seen that the radial spokes are joined at a central location that comprises an opening to be threaded onto the screw threading 78 of output shaft 76.

It will also be noted that, by virtue of this embodiment, the length of output shaft 76 may be further shortened relative to the embodiment of FIG. 4.

It will also be noted that, in all of the three embodiments according to the invention shown herein, the airfoil elements 36 at least partially occupy the annular space defined by the outer conical portion 14 and the inner conical portion 34, 80.

The operation of the FIG. 5 embodiment is the same as that of the FIGS. 1 and 4 embodiments, with the stationary inner conical surface 80 acting as a flow-directing surface, just as the rotating inner conical portion 34 of the preceding embodiments.

Although the present invention has been described in connection with various preferred embodiments thereof, it will be evident to those skilled in the art that many modifications can be made thereto as a matter of design choice, without departing from the true scope and spirit of the invention as set forth in the appended claims.

What is claimed is:

1. A pump, comprising a pump casing having mounted thereon a motor, said motor having an output shaft extending into the casing, said output shaft having secured thereto an impeller contained in said casing, said pump casing having a central inlet communicating with an outer conical-shaped portion of said casing, said central inlet and said outer conical-shaped portion of said casing facing an upstream side of said impeller, said casing further comprising a peripheral outlet disposed on a downstream side of said impeller, said impeller comprising an inner conical-shaped portion coaxial with said outer conical-shaped portion and maintained in spaced relation thereto, said inner and outer conical-shaped portions having bases and defining an annular space at their bases, said impeller comprising a circular series of airfoil elements centered on the axis of said output shaft and at least partially occupying said annular space, each of said airfoil elements having a vacuum-producing surface directed axially of said impeller towards said central inlet.

2. The pump according to claim 1, wherein said airfoil elements are rigidly secured about the periphery of the base of said inner conical-shaped portion and said output shaft if secured coaxially to the inner conical-shaped portion.

3. A pump, comprising a pump casing having mounted thereon a motor, said motor having an output shaft extending into the casing, said output shaft having secured thereto an impeller contained in said casing, said pump casing having a central inlet communicating with an outer conical-shaped portion of said casing, said central inlet and said outer conical-shaped portion of said casing facing an upstream side of said impeller, said casing further comprising a peripheral outlet disposed on a downstream side of said impeller, said casing comprising an inner conical-shaped portion coaxial with said outer conical-shaped portion and maintained in spaced relation thereto, said inner and outer conical-shaped portions having bases and defining an annular space at their bases, said impeller comprising a circular series of airfoil elements centered on the axis of said output shaft and at least partially occupying said annular space, each of said airfoil elements having a vacuum-producing surface directed axially of said impeller towards said central inlet.

4. The pump according to claim 3, wherein said inner conical-shaped portion is rigidly secured to said casing via struts maintaining said inner and outer conical-shaped portions in said spaced relation.

* * * * *